US011454097B2

(12) United States Patent
Al-Otaibi et al.

(10) Patent No.: US 11,454,097 B2
(45) **Date of Patent: *Sep. 27, 2022**

(54) ARTIFICIAL RAIN TO ENHANCE HYDROCARBON RECOVERY

(71) Applicant: Saudi Arabian Oil Company, Dhahran (SA)

(72) Inventors: Mohammed Badri Al-Otaibi, Dhahran (SA); Dong Kyu Cha, Dhahran (SA); Ali Abdallah Al-Yousef, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 17/140,200

(22) Filed: Jan. 4, 2021

(65) Prior Publication Data

US 2022/0213769 A1 Jul. 7, 2022

(51) Int. Cl.
*E21B 43/16* (2006.01)

(52) U.S. Cl.
CPC ..... *E21B 43/16* (2013.01)

(58) Field of Classification Search
CPC ..... C09K 8/00
See application file for complete search history.

(56) References Cited

U.S. PATENT DOCUMENTS 3,748,867 A * 7/1973 Bel Hamri ..... C02F 1/10 62/271
4,003,818 A 1/1977 Juillard et al.
4,296,812 A 10/1981 Kalfoglou
4,564,997 A 1/1986 Matsuo
(Continued)

FOREIGN PATENT DOCUMENTS

EP 2341372 7/2011
EP 2572187 11/2011
(Continued)

OTHER PUBLICATIONS

Akalily et al., "Artificial Rain Technology as an Alternative Increasing Sutami Reservoir Volume in Effort Tackling Drought Due to Global Climate Change," Managing Assets and Infrastructure in the Chaotic Global Economic Competitiveness, available on or before 2012, 8 pages.

(Continued)

*Primary Examiner* — William D Hutton, Jr.
*Assistant Examiner* — Avi T Skaist
(74) *Attorney, Agent, or Firm* — Fish & Richardson P.C.

(57) ABSTRACT

A hydrocarbon recovery method using artificial, fresh rain water is described. The method includes generating artificial, fresh rain water. A volume of the generated artificial, fresh rain water is mixed with a volume of brine water obtained from a brine water source to form a mixture having a water salinity that satisfies a threshold water salinity. The mixture is injected into an injection well formed in a subterranean zone. The injection well is fluidically coupled to a producing well formed in the subterranean zone to produce hydrocarbons residing in the subterranean zone. The mixture flows the hydrocarbons in the subterranean zone surrounding the producing well toward the producing well. The hydrocarbons are produced in response to injecting the mixture in the injection well.

18 Claims, 2 Drawing Sheets

(56) References Cited

U.S. PATENT DOCUMENTS

| | | | | |
|---|---|---|---|---|
| 5,191,557 | A | 3/1993 | Rector et al. | |
| 5,266,191 | A | 11/1993 | Greene et al. | |
| 5,679,885 | A | 10/1997 | Lenorman et al. | |
| 6,178,807 | B1 | 1/2001 | Baldwin et al. | |
| 7,326,931 | B2 | 2/2008 | Frodl et al. | |
| 7,681,643 | B2 | 3/2010 | Heins | |
| 7,704,746 | B1 | 4/2010 | White et al. | |
| 8,042,382 | B1 | 10/2011 | Fleury et al. | |
| 8,377,730 | B2 | 2/2013 | Yang et al. | |
| 8,466,799 | B2 | 6/2013 | Kim et al. | |
| 9,293,750 | B2 | 3/2016 | Yang et al. | |
| 10,287,486 | B2 | 5/2019 | Ayirala et al. | |
| 10,365,564 | B2 | 7/2019 | Cha et al. | |
| 10,422,733 | B2 | 9/2019 | Yang et al. | |
| 10,677,046 | B2 | 6/2020 | Mohaghegh et al. | |
| 10,705,047 | B2 | 7/2020 | Mohanty et al. | |
| 10,723,937 | B2 | 7/2020 | Ayirala et al. | |
| 11,274,534 | B2 | 3/2022 | AlOtaibi et al. | |
| 2004/0146803 | A1 | 7/2004 | Kohl et al. | |
| 2007/0246426 | A1* | 10/2007 | Collins | C09K 8/528 210/651 |
| 2008/0224717 | A1 | 9/2008 | Kim et al. | |
| 2008/0246052 | A1 | 10/2008 | Hsu | |
| 2009/0104564 | A1 | 4/2009 | Yang | |
| 2010/0190666 | A1* | 7/2010 | Ali | C09K 8/68 507/235 |
| 2010/0330721 | A1 | 12/2010 | Barlocchi et al. | |
| 2011/0015874 | A1 | 1/2011 | Song | |
| 2011/0123771 | A1 | 5/2011 | Stavis et al. | |
| 2012/0039668 | A1 | 2/2012 | Park et al. | |
| 2012/0090833 | A1* | 4/2012 | Ligthelm | C09K 8/58 166/250.01 |
| 2012/0111093 | A1 | 5/2012 | Brahim et al. | |
| 2012/0241149 | A1 | 9/2012 | Chen et al. | |
| 2012/0267603 | A1 | 10/2012 | Lee et al. | |
| 2013/0108865 | A1 | 5/2013 | Boulanger et al. | |
| 2013/0236698 | A1 | 9/2013 | Stavis et al. | |
| 2013/0261979 | A1 | 10/2013 | Al-muthana et al. | |
| 2013/0316329 | A1 | 11/2013 | Yu | |
| 2013/0325348 | A1 | 12/2013 | Valori et al. | |
| 2014/0291591 | A1 | 10/2014 | Jeon et al. | |
| 2014/0340082 | A1 | 11/2014 | Yang et al. | |
| 2014/0363623 | A1 | 12/2014 | Sun et al. | |
| 2015/0104078 | A1 | 4/2015 | Varslot et al. | |
| 2015/0219789 | A1 | 8/2015 | Pairoys | |
| 2016/0334346 | A1 | 11/2016 | Cao Minh et al. | |
| 2016/0363600 | A1 | 12/2016 | Sniadecki et al. | |
| 2017/0015893 | A1 | 1/2017 | Al-Yousef et al. | |
| 2017/0067836 | A1 | 3/2017 | Hull | |
| 2017/0114242 | A1 | 4/2017 | Lloyd et al. | |
| 2018/0224391 | A1 | 8/2018 | Choa et al. | |
| 2019/0070566 | A1* | 3/2019 | Kidambi | B01D 67/0088 |
| 2019/0346385 | A1 | 11/2019 | Reiderman et al. | |
| 2019/0368994 | A1 | 12/2019 | Al Readean et al. | |
| 2020/0371051 | A1 | 11/2020 | Chen et al. | |

FOREIGN PATENT DOCUMENTS

| | | | | |
|---|---|---|---|---|
| EP | 2716730 | | 4/2014 | |
| KR | 101301953 | | 8/2013 | |
| TW | 201743031 | | 12/2017 | |
| WO | WO 2009149362 | | 12/2009 | |
| WO | WO2010071305 | * | 6/2010 | G01W 1/00 |
| WO | WO 2017009710 | | 1/2017 | |
| WO | WO 2019032903 | | 2/2019 | |

OTHER PUBLICATIONS

Alves et al., "Influence of the salinity on the interfacial properties of a Brazilian crude oil-brine systems," Fuel (118), Feb. 15, 2014, 6 pages.

Ayirala et al., "Water ion interactions at crude oil-water interface: A new fundamental understanding of SmartWater flood," SPE paper 183894 to be presented at the SPE Middle East Oil and Gas Show and Conference, Mar. 6-9, 2017, 17 pages.

Beaubien et al., "Monitoring of near-surface gas geochemistry at the Weyburn, Canada, CO2-EOR site, 2001-2011," International Journal of Greenhouse Gas Control, Elsevier Ltd., Jun. 2013, 16(1):S236-S262, 27 pages.

Becker et al., "Polymer microfluidic devices," Taianta, 56(2), Feb. 11, 2002, 21 pages.

Chen et al., "A mechanism study of co-current and counter-current imbibition using new magnetic resonance techniques," SCA2005-38, 2005, 16 pages.

Fu et al., "Modeling and simulation of transition zones in tight carbonate reservoirs by incorporation of improved rock typing and hysteresis models," Journal of Petroleum Exploration and Production Technology, 8, 2018, 18 pages.

Galstyan et al., "TiO2 Nanotubes: Recent Advances in Synthesis and Gas Sensing Properties," Sensors, Oct. 2013, 13(11):14813-14838, 26 pages.

Goo Lee et al., "Site-Selective In Situ Grown Calcium Carbonate Micromodels with Tunable Geometry, Porosity, and Wettability," Advanced Functional Materials, 2016, 26 (27), 10 pages.

Johannesen et al., "Evaluation of wettability distributions in experimentally aged core," SCA2008-17, presented at the International Symposium of the Society of Core Analysts, Abu Dhabi, UAE, Oct. 29-Nov. 2, 2008, 12 pages.

Lakatos and Lakatos-Szabo, "Effect of IOR/EOR chemicals on interfacial rheological properties of crude oil/water systems," SPE Paper 65391 presented at the 2001 SPE International Symposium on Oilfield Chemistry, Feb. 13-16, 2001, 10 pages.

Lee et al., "Site-Selective In Situ Grown Calcium Carbonate Micromodels with Tunable Geometry, Porosity and Wettability," Advanced Functional Materials, 26, Jul. 1, 2016, 10 pages.

Liang et al., "Wettability characterization of low-permeability reservoirs using nuclear magnetic resonance: an experimental study," Journal of Petroleum Science and Engineering, Mar. 2019, 178:121-132.

Lifton, "Microfluidics: an enabling screening technology for enhanced oil recovery (EOR)," Lab on a Chip, Royal Society of Chemistry, 16(10), May 21, 2016, 20 pages.

Lu et al., "Fabrication of Nanostructure by Template Method in Microfluidics," Chinese Journal of Analytical Chemistry, 37(6), Jun. 1, 2009, 6 pages.

Maziarz et al., "Nanostructured TiO2-based gas sensors with enhanced sensitivity to reducing gases," Beilstein Journal of Nanotechnology, Nov. 2016, 7:1718-1726, 9 pages.

Mitchell et al., "Magnetic resonance imaging in laboratory petrophysical core analysis," Physics Reports, North Holland, Amsterdam, Jan. 2013, 526(3):165-225.

Nilsen et al., "Growth of Calcium Carbonate by the Atomic Layer Chemical Vapour Deposition Technique," Thin Solid Films. 2004, 450 (2), 8 pages.

OnePetro [online], available on or before Apr. 1, 2007, retrieved on Nov. 2, 2018, URL <https://www.onepetro.org/>, 2 pages.

Perrin et al., "Core-scale experimental study of relative permeability properties of CO2 and brine in reservoir rocks," Energy Procedia vol. 1, 2009, 8 pages.

Ren et al., "Materials for Microfluidic Chip Fabrication," Accounts of Chemical Research, Nov. 2013, 46(11), 12 pages.

Sander et al., "Template-Assisted Fabrication of Dense, Aligned Arrays of Titania Nanotubes with Well-Controlled Dimensions of Substrates," Advanced Materials, 16(22), Nov. 18, 2004, 6 pages.

Shi et al., "Capillary pressure and relative permeability correlations for transition zones of carbonate reservoirs," Journal of Petroleum Exploration Production and Technology, 8, 2018, 18 pages.

Siqveland et al., "Aging time control by NMR relaxation," 7th International Symposium on Reservoir Wettability, Tasmania, Australia, Jan. 1991, 10 pages.

Song et al., "Chip-off-the-old-rock: the study of reservoir-relevant geological processes with real-rock micromodels," Lab on a Chip, Royal Society of Chemistry, 14, Sep. 11, 2014, 9 pages.

Spearing et al., "Transition Zone Behaviour: The Measurement of Bounding and Scanning Relative Permeability and Capillary Pressure Curves at Reservoir Conditions for a Giant Carbonate Reser-

(56) References Cited

OTHER PUBLICATIONS voir," presented at the Abu Dhabi International petroleum Exhibition and Conference, Nov. 10-13, 2014, 14 pages.
Spende et al., "TiO2, SiO2, and Al2O3 coated nanopores and nanotubes produced by ALD in etched ion-track membranes fortransport measurements," Nanotechnology, 26, Aug. 2015, 12 pages.
Wasan et al., "Observations on the coalescence behavior of oil droplets and emulsion stability in enhanced oil recovery," Society of Petroleum Engineers of AIME, Dec. 1978, 9 pages.
Williams et al., "Applications of Magnetic resonance imaging in special core analysis studies," Reviewed Proceeding 1st Soc. Core Analysts European Core Analysis Symp. Gordon and Breach London, 1990, 30 pages.
Zheng et al., "Surface Effect on Oil Transportation in Nanochannel: a Molecular Dynamics Study," Nanoscale Research letters, 12(1), Jun. 15, 2017, 9 pages.
arabnews.jp [online], "Saudi throws its support behind cloud-seeding technology," Caline Malek, Arab News Japan, Feb. 19, 2020, retrieved on Apr. 18, 2022, retrieved from URL <https://www.arabnews.jp/en/saudi-arabia/article_11057/>, 6 pages.
PCT International Search Report and Written Opinion in International Appln. No. PCT/US2022/011155, dated Apr. 7, 2022, 13 pages.

* cited by examiner

ARTIFICIAL RAIN TO ENHANCE HYDROCARBON RECOVERY

TECHNICAL FIELD

This disclosure relates to recovering fluids, for example, hydrocarbons, entrapped in subsurface reservoirs.

BACKGROUND

Hydrocarbons residing in subsurface reservoirs can be raised to the surface of the Earth, that is, produced, by forming wells from the surface of the Earth through the subterranean zone (for example, a formation, a portion of a formation, or multiple formations) to the subsurface reservoirs. In primary hydrocarbon recovery applications, the formation pressure exerted by the subterranean zone on the hydrocarbons causes the hydrocarbons to flow into the well (called a producing well). Over time, the formation pressure decreases, and secondary recovery applications are implemented to recover the hydrocarbons from the reservoirs. Use of electrical submersible pumps (ESPs) disposed in the producing well to pump the hydrocarbons from downhole locations to the surface is an example of a secondary recovery application. Injecting fluids, for example, water, in injection wells surrounding the producing well to force the hydrocarbons in portions of the surrounding subterranean zone towards the producing well is another example of a secondary recovery application. The choice of fluid injected into the injection wells affects recovery of the hydrocarbons through the producing well.

SUMMARY

This specification describes technologies relating to artificial rain to enhance hydrocarbon recovery. Implementations of the present disclosure include a method for hydrocarbon recovery method. The hydrocarbon recovery method includes generating artificial, fresh rain water. The method includes mixing a volume of the generated artificial, fresh rain water with a volume of brine water obtained from a brine water source to form a mixture having a water salinity that satisfies a threshold water salinity. The method includes injecting the mixture in an injection well formed in a subterranean zone. The injection well is fluidically coupled to a producing well formed in the subterranean zone to produce hydrocarbons residing in the subterranean zone. The mixture flows the hydrocarbons in the subterranean zone surrounding the producing well toward the producing well. The method includes producing the hydrocarbons in response to injecting the mixture in the injection well.

In some implementations, generating the artificial, fresh rain water further includes seeding clouds above the fresh water reservoir with salt configured to draw water vapor in the atmosphere and condense the drawn water vapor into water droplets that combine to form the artificial, fresh rain water.

In some implementations, the seeding the clouds further includes dropping a quantity of the salt sufficient to draw the water vapor by an airplane.

In some implementations, the salt further includes silver iodide.

In some implementations, the method further includes storing the generated artificial, fresh rain water in a fresh water reservoir positioned below a surface of the Earth in the subterranean zone adjacent the injection well. The method can further include obtaining the brine water from the brine water source, storing the obtained brine water in a brine water reservoir positioned adjacent the fresh water reservoir, and fluidically coupling the fresh water reservoir and the brine water reservoir. In some implementations, the brine water source is a sea. In some implementations, installing the brine water reservoir directly vertically below the fresh water reservoir. In some implementations, obtaining the brine water from the brine water source can further include drawing the brine water through a pipeline that fluidically couples the sea and the brine water reservoir. The method can include, where the clouds are directly above the fresh water reservoir, the method further includes installing a plurality of rain water collectors on the surface of the Earth directly below the clouds and fluidically coupling the plurality of rain water collectors to the fresh water reservoir.

In some implementations, where the artificial, fresh rain water has a lower water salinity compared to the brine water, the method further includes controlling the water salinity of the mixture. Controlling the water salinity of the mixture can further include measuring the water salinity of the mixture before injecting the mixture in the injection well, determining that the measured water salinity is different from the threshold water salinity, and modifying the volume of the artificial, fresh rain water flowed from the fresh water reservoir into the mixing reservoir to mix with the volume of the brine water until the measured water salinity of the mixture matches the threshold water salinity.

Further implementations of the present disclosure include a hydrocarbon recovery method including mixing artificially generated fresh rain water with sea water obtained from a sea to form a mixture, controlling a water salinity of the mixture to satisfy a threshold water salinity, injecting the mixture having the water salinity that satisfies the threshold water salinity in an injection well formed in a subterranean zone, and producing the hydrocarbons in response to injecting the mixture in the injection well. The injection well surrounding a producing well is formed in the subterranean zone to produce hydrocarbons residing in the subterranean zone. The mixture flows the hydrocarbons in the subterranean zone surrounding the producing well toward the producing well. The method can further include installing a plurality of rain water collectors on the surface of the Earth directly below the clouds and fluidically coupling the plurality of rain water collectors to the fresh water reservoir.

In some implementations, the artificial, fresh rain water is generated by seeding clouds with salt configured to draw water vapor in the atmosphere and condense the drawn water vapor into water droplets that combine to form the artificial, fresh rain water and storing the generated artificial, fresh rain water in a fresh water reservoir positioned below a surface of the Earth in the subterranean zone adjacent the injection well. Seeding the clouds can further include dropping a quantity of the salt sufficient to draw the water vapor by an airplane. The method can further include obtaining the sea water from the sea, storing the obtained brine water in a sea water reservoir positioned directly, vertically below the fresh water reservoir, and fluidically coupling the fresh water reservoir and the sea water reservoir. Controlling the water salinity of the mixture can further include measuring the water salinity of the mixture before injecting the mixture in the injection well, determining that the measured water salinity is different from the threshold water salinity, and modifying a quantity of the artificial, fresh rain water flowed from the fresh water reservoir into the mixing reservoir until the measured water salinity of the mixture matches the threshold water salinity.

In some implementations, the fresh water reservoir is directly, vertically below the clouds.

Implementations of the present disclosure realize one or more of the following advantages. The quantity of oil recovered from a subterranean zone is increased. For example, reducing the salinity of the water injected into the subterranean zone using artificial rain can change the wettability (that is, the measure of a liquid's ability to maintain contact with the reservoir), increasing the quantity of oil recovered per recovery operation. Reducing the injection water salinity can enhance the chemical interactions with rock minerals and its adsorbed oil components. As a result, the rock wettability altered from oil-wet towards water-wet. Oil droplets will be subsequently released from the rock surfaces in a process called oil recovery enhancement. Also, waterflooding operations can be used in geographic regions where natural rainfall can be scarce. The cost of fresh water may be reduced. Current methods for providing fresh water for enhanced oil recovery in many regions of the world include large, complex desalination plants. Artificial rain water can be generated and collected at the reservoir location.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

The present disclosure relates to a method of hydrocarbon recovery using artificial rain. Fresh rain water is artificially generated. A volume of brine water is obtained from a brine water source. The volume of the generated artificial fresh rain water is mixed with the volume of brine water to form a mixture having a water salinity that satisfies a threshold water salinity. The resulting mixture is injected in an injection well formed in a subterranean zone. The injection well is fluidically connected to a producing well by the subterranean zone. The subterranean zone contains hydrocarbons. The mixture flows from the injection well into the subterranean zone and forces the hydrocarbons from the subterranean formation toward the producing well. The producing well produces the hydrocarbons in response to injecting the mixture in the injection well.

Figure 1:
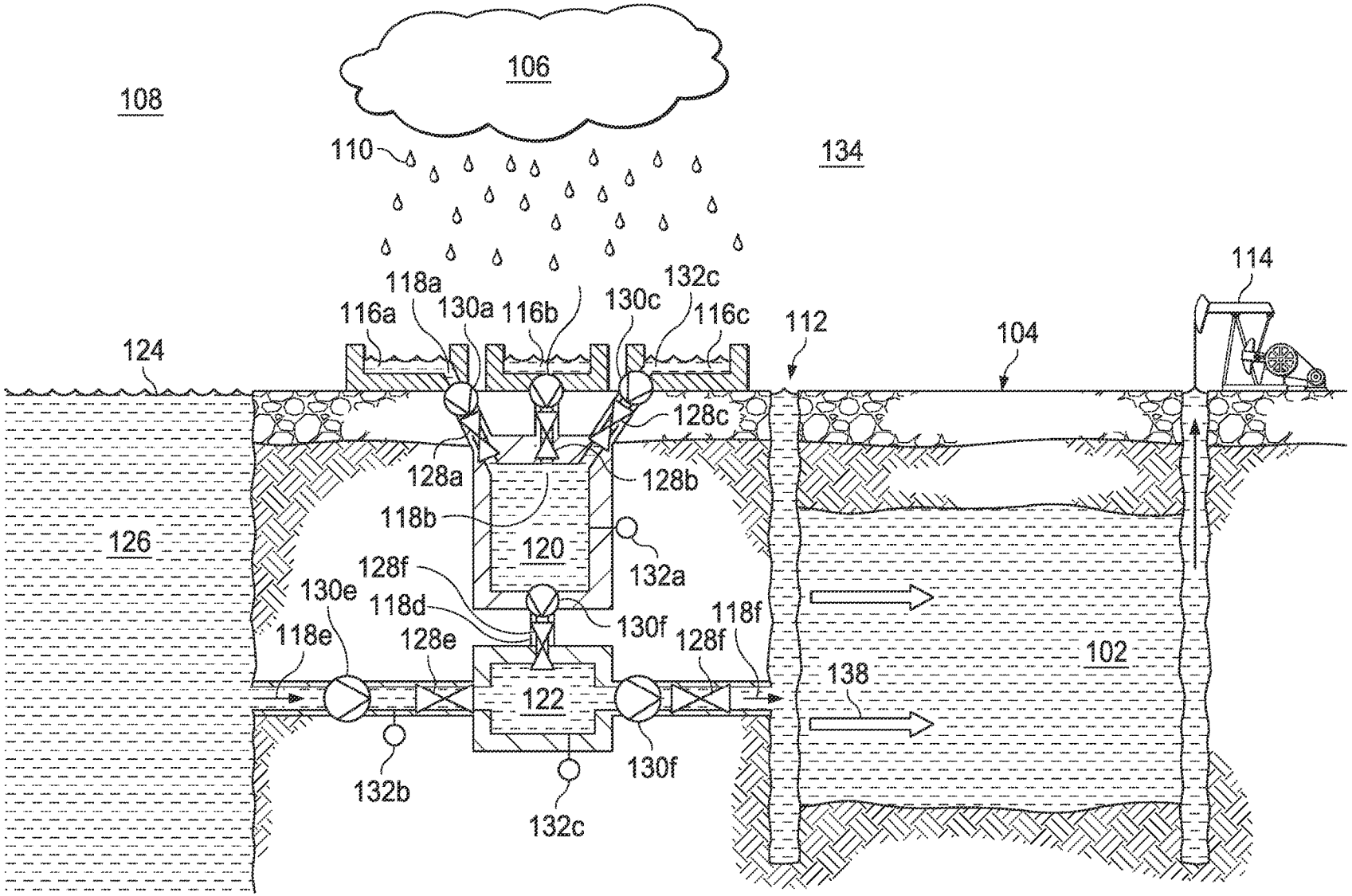
FIG. 1 is a schematic view of an artificial fresh rain water generation system for enhanced oil recovery.

As shown in FIG. 1, an artificial fresh rain water generation system 100 is fluidically connected to a subterranean zone 102 for enhanced oil recovery from the subterranean zone 102. Clouds 106 in an atmosphere 108 of the Earth contain moisture that that condense into water droplets to generate natural fresh rain water Clouds 106 can artificially generate artificial fresh rain water 110. In some cases, a production wells 114 and injection wells 112 are formed in geographic regions with low rain fall. Operating production wells 114 and injection wells 112 in such regions requires importing water from other geographic locations given that there is insufficient quantities in the geographic region containing the production wells 114 and injection wells 112. In some cases, natural fresh rain water from clouds 106 cannot be produced in sufficient quantities. For example, this can occur in geographic areas with historically low rain fall levels like arid climates or desert regions. Alternatively, a geographic region can experience time periods of decreased or no natural rain fall. For example, a drought can occur. Abnormal weather patterns potentially related to climate change can exacerbate these periods of decreased natural rain fall.

In some implementations, clouds 106 can be seeded with a salt. Seeding the clouds 106 with salt draws water vapor in the atmosphere 108 into the clouds 106. The drawn water vapor can condense into water droplets that combine to form the artificial fresh rain water 110, similar to the process by which natural rain water is formed. The salt can be silver iodide. In some implementations, a quantity of the salt can be dispersed or dropped into the cloud in a sufficient quantity to draw the water vapor in the atmosphere 108 into the clouds 106. The quantity of the salt sufficient to draw the water vapor can be dropped by an airplane. Silver iodide (AgI) may be released by a generator that vaporizes an acetone-silver iodide solution containing 1-2% AgI and produces aerosols with particles of 0.1 to 0.01 μm diameter. The relative amounts of AgI and other solubilizing agents are usually adjusted based on the yield, nucleation mechanism, and ice crystal production rates.

Clouds seeding with silver iodide can be only effective if the cloud is super-cooled and the proper ratio of cloud droplets to ice crystals exists. Silver iodide acts as an effective ice nucleus at temperature of 25° F. (−4° C.) and lower. Several factors can impact artificial rain processes such as the type of cloud, its temperature, moisture content, droplet size distribution, and updraft velocities in the cloud. Additional steps that can increase the likelihood of rain is the methodology of the cloud seeding operations which includes identification the suitable situation based on the previously mentioned factors, arrangement of an appropriate seeding agent, and successful transport and diffusion or direct placement of the seeding agent to the super-cooled liquid and vapor must be available to provide precipitation. Using numerical models can be important to evaluate seeding potential and its efficiency.

Alternatively, a laser pulse may be able to produce condensation in the atmosphere 108. Firing a laser beam made up of short pulses into the air ionizes nitrogen and oxygen molecules around the beam to create a plasma, resulting in a 'plasma channel' of ionized molecules. These ionized molecules could act as natural condensation nuclei.

The clouds 106 that are selectively seeded by the salt are situated over multiple rain water collectors (for example, rain water collectors 116*a*, 116*b*, and 116*c*). The multiple rain water collectors 116*a*, 116*b*, and 116*c* are directly below the clouds 106. By directly below the clouds 106, it is meant that at least some, a substantial portion, or all of the artificial fresh rain water 110 falling from the clouds 106 can be collected in the rain water collectors 116*a*, 116*b*, and 116*c* as the artificial fresh rain water 110 lands on the surface 104 of the Earth. The rain water collectors are stationary and adjacent to the injection well site. Alternatively, movable or transportable rain water collectors can be used.

The rain water collectors 116*a*, 116*b*, and 116*c* can be surface reservoirs. The surface reservoirs can be constructed from Earth materials, for example, rocks, dirt, soil, and sand positioned to retain water. The surface 104 of the Earth in the rain water collectors 116*a*, 116*b*, and 116*c* can be lined to prevent the artificial fresh rain water 110 from absorbing into the Earth. For example, a plastic liner can be placed in the rain water collectors 116*a*, 116*b*, and 116*c*. Alternatively, or in addition, the rain water collectors 116*a*, 116*b*, and 116*c* can be constructed from a plastic or metal. For example, the rain water collectors 116*a*, 116*b*, and 116*c* can be tanks. In some implementations, the rain water collectors 116*a*, 116*b*, and 116*c* can be partially covered by a cover (not shown) to reduce artificial fresh rain water 110 losses to the atmosphere 108 by evaporation. The cover can collect the artificial fresh rain water 110 falling from the clouds 106 and direct the artificial fresh rain water 110 to the rain water collectors 116*a*, 116*b*, and 116*c*.

The rain water collectors 116*a*, 116*b*, and 116*c* are fluidically connected to a water reservoir 120 by flow conduits (for example, flow conduits 118*a*, 118*b*, and 118*c* fluidically connected to rain water collectors 116*a*, 116*b*, and 116*c*, respectively). The flow conduits 118*a*, 118*b*, and 118*c* allow flow from the rain water collectors 116*a*, 116*b*, and 116*c* to the water reservoir 120.

A valve 128 can be positioned in each of the flow conduits 118*a*, 118*b*, and 118*c* to control flow from the rain water collectors 116*a*, 116*b*, and 116*c* to the water reservoir 120. For example, valve 128*a*, valve 128*b*, and valve 128*c* can be positioned in flow conduits 118*a*, 118*b*, and 118*c*, respectively, to control the flow the artificial fresh rain water 110 from the rain water collectors 116*a*, 116*b*, and 116*c*, respectively, to the water reservoir 120. For example, valve 128*a* can open to allow artificial fresh rain water 110 to flow from rain water collector 116*a* through flow conduit 118*a* to the water reservoir 120. For example, valve 128*a* can shut to stop artificial fresh rain water 110 from flowing from rain water collector 116*a* through flow conduit 118*a* to the water reservoir 120. For example, valve 128*a* can partially open or partially shut to increase or decrease, respectively, the quantity of artificial fresh rain water 110 flowed from rain water collector 116*a* through flow conduit 118*a* to the water reservoir 120.

In some implementations, the valve 128*a*, valve 128*b*, and valve 128*c* can be operated manually. In some implementations, the valve 128*a*, valve 128*b*, and valve 128*c* can be operated remotely by the controller 134. For example, the controller 134 may generate a signal to energize the valve 128*a* open to flow a quantity of artificial fresh rain water 110 from the rain water collector 116*a* to the water reservoir 120.

A pump (for example, pump 130*a*, pump 130*b*, and pump 130*c*) can be positioned in each of the flow conduits 118*a*, 118*b*, and 118*c* to move the artificial fresh rain water 110 from the rain water collectors 116*a*, 116*b*, and 116*c* to the water reservoir 120. For example, pump 130*a*, pump 130*b*, and pump 130*c* can positioned in flow conduits 118*a*, 118*b*, and 118*c*, respectively, to flow the artificial rain water 110 to the water reservoir 120. In some implementations, the pump 130*a*, pump 130*b*, and pump 130*c* can be operated manually. In other implementations, the pump 130*a*, pump 130*b*, and pump 130*c* can be operated remotely by the controller 134. For example, the controller 134 may generate a signal to energize the pump 130*a* to flow a quantity of artificial fresh rain water 110 from the rain water collector 116*a* to the water reservoir 120.

The flow conduits 116*a*, 116*b*, and 116*c* can include various sensors 132*d*, 132*e*, and 132*f*, respectively, configured to sense fluid conditions and transmit the fluid conditions to the controller 134. For example, the sensors 132*d*, 132*e*, and 132*f*, can sense fluid pressure, temperature, flow rate, salinity, or conductivity in flow conduits 116*a*, 116*b*, and 116*c*, respectively.

The water reservoir 120 collects and stores the artificial fresh rain water 110 from the rain water collectors 116*a*, 116*b*, and 116*c* via the flow conduits 118*a*, 118*b*, and 118*c*. The water reservoir 120 can be underground, that is, beneath the surface 104 of the Earth. The water reservoir 120 can be constructed from a plastic or metal. For example, the water reservoir 120 can be a tank. The water reservoir 120 is fluidically connected to a mixing reservoir 122 by a flow conduit 118*d*, substantially similar to the flow conduits 118*a*, 118*b*, and 118*c* described earlier. A pump 130*d* may be positioned in flow conduit 118*d* to flow artificial fresh rain water 110 from the water reservoir 120 to the mixing reservoir 122. A valve 128*d* can be positioned in flow conduit 118*d* to control the flow of artificial fresh rain water 110 from the water reservoir 120 to the mixing reservoir 122.

The mixing reservoir 122 receives the artificial fresh rain water 110 from the water reservoir 120 through the flow conduit 118*d*. The mixing reservoir 122 also receives brine water from a brine water source through another fluid conduit 118*e*. The brine water source can be a sea 124. The brine water can be sea water 126. Alternatively, the brine water source can be a brine fluid from another subterranean zone. Another potential source for brine water can be an industrial plant, for example, a desalinization plant where brine water is a byproduct of an industrial process. Produced water from other production wells can be reinjected a source for brine water.

The flow conduit 118*e* is substantially similar to the flow conduits discussed earlier. A pump 130*e* can be positioned in flow conduit 118*e* to flow sea water 126 from the sea 124 to the mixing reservoir 122. A valve 128*e* can be positioned in flow conduit 118*e* to control the flow of sea water 124 from the sea 126 to the mixing reservoir 122.

In some implementations, the artificial fresh rain water 110 and the sea water 126 mix in the mixing reservoir 122 by the flow of the artificial fresh rain water 110 and the sea water 126 into the mixing reservoir 122. The artificial fresh rain water 110 and the sea water 126 may mix in the mixing reservoir 122 by diffusion. In other implementations, the mixing reservoir 122 has a component to actively mix the artificial fresh rain water 110 and the sea water 126 mix in the mixing reservoir 122. For example, the mixing reservoir can include a pump, a nozzle, an impeller, or an aeration system.

The mixing reservoir 122 includes a flow conduit 118*f* to flow a mixture of the artificial fresh rain water 110 and the sea water 126 to an injection well 112. The flow conduit 118*f* is substantially similar to the flow conduits described earlier. A pump 130*f* may be positioned in flow conduit 118*f* to flow the mixture from the mixing reservoir 122 to the injection well 112. A valve 128*f* can be positioned in flow conduit 118*f* to control the flow of the mixture from the mixing reservoir 122 to the injection well 112.

The different features described here can include sensors that can sense fluid properties and transmit a signal to a controller 134 (described later) to control flow of the mixture based on the sensed value. For example, the rain water collectors 116*a*, 116*b*, and 116*c*, the water reservoir 120, the various flow conduits, and the mixing reservoir 122 can include sensors. Examples of the fluid properties sensed by the sensors include fluid level (in the case of a reservoir), temperature, salinity, pH, flow rate, resistivity, or conductivity. For example, a sensor 132*a* can be disposed in the water reservoir 120 to sense resistivity of the artificial fresh rain water 110. A signal representing the resistivity of the artificial fresh rain water 110 in the water reservoir 120 can be sent to the controller 134. Based on the resistivity value in the water reservoir 120, the controller 134 can control the flow of the artificial fresh rain water 110 into the mixing reservoir 122. For example, a sensor 132*b* can be disposed in the sea water 126 flow conduit 132*b* to sense resistivity of the sea water 126. A signal representing the resistivity of the sea water 126 in the flow conduit 118*e* can be sent to the controller 134. Based on the resistivity value in the flow conduit 118*e*, the controller 134 can control the flow of the sea water 126 into the mixing reservoir 122. For example, a sensor 132*c* can be disposed in the mixture in the mixing reservoir 122 to sense resistivity of the mixture. A signal representing the resistivity of the mixture in the mixing reservoir 122 in can be sent to the controller 134. Based on the resistivity value in the mixing reservoir 122, the controller 134 can control the flow of the sea water 126 or the artificial fresh rain water 110 into the mixing reservoir 122.

The controller 134 can be a non-transitory computer-readable medium storing instructions executable by one or more processors to perform operations described here. In some implementations, the controller 134 includes firmware, software, hardware or combinations of them. The instructions, when executed by the one or more computer processors, cause the one or more computer processors to control the salinity of the mixture in the mixing reservoir 122 when the artificial fresh rain water has a lower water salinity compared to the sea water.

The controller 134 can control the salinity of the mixture by measuring the salinity of the mixture before injecting the mixture in the injection well 112 and flowing a quantity of artificial fresh rain water 110 from the water reservoir 120 or a quantity of sea water 126 from the sea 124 based on the salinity of the mixture. The controller 134 can receive a signal representing the conditions of the artificial fresh rain water 110 in the water reservoir 120 from sensors 132*g*. For example, the controller 134 receives signals representing the fluid level, temperature, salinity, pH, or conductivity in water reservoir 120. The controller 134 can receive signal representing the conditions of the sea water 126 in the flow conduit 118*e* from sensors 132*j*. For example, the controller 134 receives signals representing the fluid flow rate, temperature, salinity, pH, or conductivity in flow conduit 118*e*. The controller 134 can receive signal representing the conditions of the mixture in the mixing reservoir 122 from sensors 132*i*. For example, the controller 132 receives signals representing the fluid level, temperature, salinity, pH, or conductivity in mixing reservoir 120.

The controller can determine that the measured salinity of the mixture in the mixing reservoir 122 is different from the threshold water salinity. The controller 134 can modify the volume of the artificial, fresh rain water 110 flowed from the fresh water reservoir 120 into the mixing reservoir 122 to mix with the volume of the sea water until the measured water salinity of the mixture matches the threshold water salinity. The controller 134 can generate signals to operate pump 130*d* to flow artificial fresh rain water 110 from the water reservoir 120 to the mixing reservoir 122 until the measured water salinity of the mixture matches the threshold water salinity. Alternatively or in addition, the controller 134 can generate signals to operate valve 128*d* to flow artificial fresh rain water 110 from the water reservoir 120 to the mixing reservoir 122 until the measured water salinity of the mixture matches the threshold water salinity. For example, the controller 134 commands valve 128*d* open to allow artificial fresh rain water 110 flow from the water reservoir 120 to the mixing reservoir 122. Subsequently, the controller 134 commands valve 128*d* can shut to stop artificial fresh rain water 110 from the water reservoir 120 to the mixing reservoir 122. Alternatively or in addition, the controller 134 commands valve 128*d* can partially open or partially shut to increase or decrease, respectively, the quantity of artificial fresh rain water 110 flowed from the water reservoir 120 to the mixing reservoir 122.

The injection well 112 is positioned in the subterranean zone 102 and extends from the surface 104 of the Earth downward to the subterranean zone 102 of the Earth. The injection well 112 receives the mixture from the mixing reservoir 122. The injection well 112 is fluidically coupled to the subterranean zone 102. The injection well 112 raises the pressure of the mixture to a pressure above a subterranean zone 102 pressure. The injection well 112 injects the pressurized mixture from the mixing reservoir 122 into the subterranean zone 102.

The subterranean zone 102 is the geologic formations of the Earth. The subterranean zone 102 can be contain both liquid and gaseous phases of various fluids and chemicals including water, oils, and hydrocarbon gases. The subterranean zone 102 receives the pressurized mixture from the injection well 112. The pressurized mixture forces a fluid flow, indicated by arrow 138 from the injection well 112 through the subterranean zone 102 to a production well 114.

The production well 114 extends from the surface 104 of the Earth downward to the subterranean zone 102 of the Earth. The production well 114 conducts the fluids and chemicals from the subterranean zone 102 of the Earth to the surface 104 of the Earth. The production well 114 can also be known as the producing well. Once on the surface 104 of the Earth, the fluids and chemicals can be stored or transported for refining into useable products.

In some implementations, an observation well (not shown) can be drilled into the subterranean zone 102. Sensors, substantially similar to the sensors described earlier, can be positioned in the observation well in the subterranean zone to sense fluid properties of the subterranean zone. The sensors in the subterranean zone can transmit a signal representing the fluid conditions in the subterranean formation 102 to the controller 134. The controller 134 can control the flow of the mixture to the subterranean zone 102 based on the sensed values.

Figure 2:
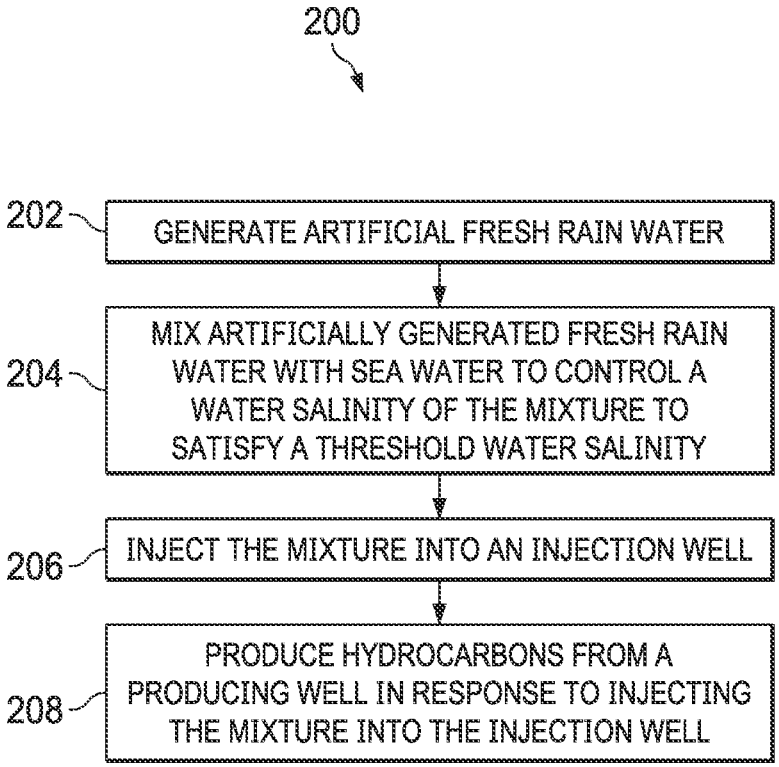
FIG. 2 is a flow chart of an example method of enhanced oil recovery using the artificial fresh rain water generation system of FIG. 1.

FIG. 2 is a flow chart of an example method of enhanced oil recovery using the artificial fresh rain water generation system of FIG. 1. At 202, artificial, fresh rain water is generated. Generating artificial, fresh rain water can include storing the generated artificial fresh rain water in a fresh water reservoir positioned below a surface of the Earth in a subterranean zone adjacent to an injection well. Generating the artificial, fresh rain water can include seeding clouds above the fresh water reservoir with salt configured to draw water vapor in the atmosphere and condense the drawn water vapor into water droplets that combine to form the artificial, fresh rain water. Seeding the clouds can include dropping a quantity of the salt sufficient to draw the water vapor by an airplane. The salt can be silver iodide. When the seeded clouds are directly above the fresh water reservoir, the method includes installing multiple rain water collectors on the surface of the Earth directly below the clouds. The multiple rain water collectors are fluidically coupled to the fresh water reservoir.

At 204, a volume of the generated artificial, fresh rain water is mixed with a volume of brine water obtained from a brine water source to form a mixture having a water salinity that satisfies a threshold water salinity. Obtaining the brine water from the brine water source can include storing the obtained brine water in a brine water reservoir positioned adjacent the fresh water reservoir and fluidically coupling the fresh water reservoir and the brine water reservoir. Where the brine water source is a sea, obtaining the brine water from the brine water source includes drawing the brine water through a pipeline that fluidically couples the sea and the brine water reservoir. The method can include installing the brine water reservoir directly vertically below the fresh water reservoir. Where the artificial, fresh rain water has a lower water salinity compared to the brine water, the method includes controlling the water salinity of the mixture. Controlling the water salinity of the mixture can include measuring the water salinity of the mixture before injecting the mixture in the injection well, determining that the measured water salinity is different from the threshold water salinity, and modifying the volume of the artificial, fresh rain water flowed from the fresh water reservoir into the mixing reservoir to mix with the volume of the brine water until the measured water salinity of the mixture matches the threshold water salinity.

At 206, the mixture is injecting into the injection well formed in a subterranean zone. The injection well is fluidically coupled to a producing well by the subterranean zone. The producing well is formed in the subterranean zone to produce hydrocarbons residing in the subterranean zone. The mixture flows the hydrocarbons in the subterranean zone surrounding the producing well toward the producing well. At 208, the hydrocarbons are produced in response to injecting the mixture in the injection well.

Certain implementations have been described to recover hydrocarbons using artificial, fresh rain water by controlling salinity of the mixture. The techniques described here can alternatively or additionally be implemented to control other fluid properties. For example, total dissolved solids or pH can be controlled.

Thus, particular implementations of the subject matter have been described. Other implementations are within the scope of the following claims.

The invention claimed is:

1. A hydrocarbon recovery method comprising:

generating artificial, fresh rain water by seeding clouds with salt;

mixing a volume of the generated artificial, fresh rain water with a volume of brine water obtained from a brine water source to forma mixture having a water salinity that satisfies a threshold water salinity;

injecting the mixture in an injection well formed in a subterranean zone, the injection well fluidically coupled to a producing well formed in the subterranean zone to produce hydrocarbons residing in the subterranean zone, wherein the mixture flows the hydrocarbons in the subterranean zone surrounding the producing well toward the producing well; and producing the hydrocarbons in response to injecting the mixture in the injection well.

2. The method of claim 1, further comprising storing the generated artificial, fresh rain water in a fresh water reservoir positioned below a surface of the Earth in the subterranean zone adjacent the injection well.

3. The method of claim 2, wherein generating the artificial, fresh rain water by seeding clouds with salt comprises seeding clouds above the fresh water reservoir with salt configured to draw water vapor in the atmosphere and condense the drawn water vapor into water droplets that combine to form the artificial, fresh rain water.

4. The method of claim 3, wherein the salt comprises silver iodide.

5. The method of claim 3, wherein seeding the clouds comprises dropping, by an airplane, a quantity of the salt sufficient to draw the water vapor.

6. The method of claim 3, wherein the clouds are directly above the fresh water reservoir, wherein the method further comprises:

installing a plurality of rain water collectors on the surface of the Earth directly below the clouds; and fluidically coupling the plurality of rain water collectors to the fresh water reservoir.

7. The method of claim 2, further comprising:

obtaining the brine water from the brine water source;

storing the obtained brine water in a brine water reservoir positioned adjacent the fresh water reservoir; and fluidically coupling the fresh water reservoir and the brine water reservoir.

8. The method of claim 7, wherein the brine water source is a sea, wherein obtaining the brine water from the brine water source comprises drawing the brine water through a pipeline that fluidically couples the sea and the brine water reservoir.

9. The method of claim 7, further comprising installing the brine water reservoir directly vertically below the fresh water reservoir.

10. The method of claim 7, wherein the artificial, fresh rain water has a lower water salinity compared to the brine water, wherein the method further comprises controlling the water salinity of the mixture.

11. The method of claim 10, wherein controlling the water salinity of the mixture comprises:

measuring the water salinity of the mixture before injecting the mixture in the injection well;

determining that the measured water salinity is different from the threshold water salinity; and modifying the volume of the artificial, fresh rain water flowed from the fresh water reservoir into the mixing reservoir to mix with the volume of the brine water until the measured water salinity of the mixture matches the threshold water salinity.

12. A hydrocarbon recovery method comprising:

mixing artificially generated fresh rain water obtained by seeding clouds with salt with sea water obtained from a sea to form a mixture;

controlling a water salinity of the mixture to satisfy a threshold water salinity;

injecting the mixture having the water salinity that satisfies the threshold water salinity in an injection well formed in a subterranean zone, the injection well surrounding a producing well formed in the subterranean zone to produce hydrocarbons residing in the subterranean zone, wherein the mixture flows the hydrocarbons in the subterranean zone surrounding the producing well toward the producing well; and producing the hydrocarbons in response to injecting the mixture in the injection well.

13. The method of claim 12, further comprising:

generating the artificial, fresh rain water by seeding clouds with salt configured to draw water vapor in the atmosphere and condense the drawn water vapor into water droplets that combine to form the artificial, fresh rain water; and storing the generated artificial, fresh rain water in a fresh water reservoir positioned below a surface of the Earth in the subterranean zone adjacent the injection well.

14. The method of claim 13, wherein the fresh water reservoir is directly, vertically below the clouds.

15. The method of claim 14, wherein the method further comprises:

installing a plurality of rain water collectors on the surface of the Earth directly below the clouds; and fluidically coupling the plurality of rain water collectors to the fresh water reservoir.

16. The method of claim 13, wherein seeding the clouds comprises dropping, by an airplane, a quantity of the salt sufficient to draw the water vapor.

17. The method of claim 13, further comprising:

obtaining the sea water from the sea;

storing the obtained sea water in a sea water reservoir positioned directly, vertically below the fresh water reservoir; and fluidically coupling the fresh water reservoir and the sea water reservoir.

18. The method of claim 12, wherein controlling the water salinity of the mixture comprises:

measuring the water salinity of the mixture before injecting the mixture in the injection well;

determining that the measured water salinity is different from the threshold water salinity; and modifying a quantity of the artificial, fresh rain water flowed from the fresh water reservoir into the mixing reservoir until the measured water salinity of the mixture matches the threshold water salinity.

* * * * *